US005250875A

United States Patent [19]

Kho

[11] Patent Number: 5,250,875

[45] Date of Patent: Oct. 5, 1993

[54] ELECTRON GUN FOR A CATHODE RAY TUBE

[75] Inventor: Nam J. Kho, Kyungsangbuk, Rep. of Korea

[73] Assignee: GoldStar Co., Ltd., Rep. of Korea

[21] Appl. No.: 753,171

[22] Filed: Aug. 30, 1991

[30] Foreign Application Priority Data

Aug. 31, 1990 [KR] Rep. of Korea ..... 90 13720

[51] Int. Cl.[5] ..... H01J 29/50; H01J 29/62

[52] U.S. Cl. ..... 313/414; 313/449

[58] Field of Search ..... 313/414, 449

[56] References Cited

U.S. PATENT DOCUMENTS

| | | | |
|---|---|---|---|
| 4,833,365 | 5/1989 | Shirai et al. | 313/414 |
| 4,866,335 | 9/1989 | Cho | 313/414 X |
| 5,081,393 | 1/1992 | Kinami | 313/414 X |

*Primary Examiner*—Palmer C. Demeo

*Attorney, Agent, or Firm*—Morgan & Finnegan

[57] ABSTRACT

An electron gun for a cathode ray tube arranged in sequence following by a cathode, a first grid electrode, a second grid electrode, a first accelerating/focusing electrode, and a second accelerating/focusing electrode from the lower on the axis of the cathoderay tube, comprises a third grid electrode assembly including an inter-grid assembly installed between the lower electrode and the upper electrode which is made into the first accelerating/focusing electrode, a main electrostatic focusing lens mounted between the fourth grid electrode to be considered as the second accelerating/focusing electrode and the upper electrode of the third grid electrode assembly and other electrostatic focusing lens formed between the inter-grid assemblies which is installed in the third grid electrode assembly, in which the drift space of the electron beam is secured in the electron gun and the focusing electrode of the main electrostatic focusing electrode, which is applied to a lower voltage, is devided into two to get the inter-grid assembly made of ceramics to be integrally installed therebetween, so that the focusing performance of the electron beam enables the multi-focusing effect to be obtained, and the configuration of one focusing electrode in the outer form is contributed to the assembly and accuracy.

8 Claims, 3 Drawing Sheets

ELECTRON GUN FOR A CATHODE RAY TUBE

FIELD OF THE INVENTION

The invention relates generally to an electron gun for a cathode ray tube for obtaining a multi-focusing effect by the focusing of an electron beam, and specifically for enhancing the assembly and accuracy of the focusing electrode in which the drift space of the electron beam is assured and the focusing electrode includes an inter-grid assembly integrally installed therein.

BACKGROUND OF THE INVENTION

Generally, an electron gun for a cathode ray tube includes a triode arranged in order of a cathode, a first grid and a second grid on the axis and at least one electrode forming a plurality of main electrostatic focusing lens. The main electrostatic focusing lenses are classified into various forms. The most fundamental types of the main electrostatic focusing lens are a Bi-Potential focus lens and an Uni-Potential focus lens which are well known.

Specially, the main electrostatic focusing lens simplified and adapted to a color cathode ray tube has the typical configuration as shown in FIG. 1, which includes a triode followed in sequence by a cathode 1, a first grid electrode 2 and a second grid electrode 3; and main electrostatic focusing lens provided with a third grid electrode 4 and a fourth grid electrode 5, but due to the difficulties of the electrode manufacture in a relative longer length so as to assure a drift space of an electron beam in an electron gun the third grid electrode 4 is provided with a third grid lower electrode 6 and a third grid upper electrode 7 each of which is separately produced and which are connected to each other. The fourth grid electrode 5 is applied to an ultra-high voltage (Eb) of 20–30 KV, and the third grid electrode 4 is connected to the focusing voltage (Vf) corresponding to 18–30% of the ultra-high voltage (Eb).

When each of the electrodes of the electron gun for a color cathode ray tube is put under a predetermined operation voltage, the cathode emits thermionic electrons. The second grid electrode 3 accelerates the thermionic electrons by the voltage applied thereto in order to form an electron beam. At this time, the first grid electrode 2 serves to adjust the amount of the electron beam to be emitted. A configuration as described above called a triode is mounted in the front of the electrode of a focusing lens system independently of the types of an electron gun for a cathode ray tube.

The electron beam emitted from the triode continues to pass in a linear form through the drift space distributed at an equal potential in the electron gun so as to be moved into the main electrostatic focusing lens without a change in its direction. On the other hand, the main electrostatic focusing lens has an equal potential circulated through the focusing voltage (Vf) applied to the upper electrode of the third grid electrode 4 and the ultra-high voltage (Eb) supplied to the fourth grid electrode 5. The incident electron beam into the main electrostatic focusing lens is focused with a pointed end in accordance with Lagrange's theorem. Thus, the focusing performance of the main electrostatic focusing lens is determined by the ratio of the focusing voltage (Vf) to the ultra-high voltage (Eb).

Referring to the equivalently optical simulation view of an electron gun as shown in FIG. 5A relative to the focusing performance of a main electrostatic focusing lens in the electron gun for a color cathode ray tube, the distance from the main electrostatic focusing lens to the screen of the cathode ray tube is called an Image distance (Q). If the image distance (Q) is constant, the greater the ratio of the focusing voltage (Vf) to the ultra-high voltage (Eb), the longer the focus distance of the main electrostatic focusing lens. If the object distance (P) from the main electrostatic focusing lens to a virtual object is made longer, a beam spot is focused at the screen of the cathode ray tube based on an equation (1) indicating an optical magnification.

$$M = \frac{Q}{P} \tag{1}$$

On the contrary, the smaller the ratio of the focusing voltage (Vf) to the ultra-high voltage (Eb), the shorter the focus distance of the main electrostatic focusing lens. If the object distance (P) from the main electrostatic focusing lens to a virtual object is relatively made closer, the optical magnification based on an equation (1) is made larger.

As a result, because a cathode ray tube for a higher resolution requires a beam spot as small as possible, the magnification of a electron gun must become less. Namely that is why the beam spot (Dx=Mdx) of the cathode ray tube is to enlarge the size (dx) of a virtual object in a main electrostatic focusing lens by the magnification of a focusing lens. The voltage for heightening the ratio of the focusing voltage (Vf) to the ultra-voltage (Eb) is applied to the electrodes constituting the main electrostatic focusing lens for the color cathode ray tube so as to increase the object distance (P). Due to it, there must be formed the main electrostatic focusing lens having a smaller magnification based on the general equation (1).

When the ratio of the focusing voltage (Vf) to the ultra-voltage (Eb) is high, the object distance (P) is increased. Thus, it is preferable to extend the length of the third grid electrode 4 in order to maintain the corresponding drift space in the electron gun.

Also, FIG. 6 is a graph illustrating the correlation between the length (a) of the third grid electrode 4 and the size (rf) of the beam spot considering the ratio of the focusing voltage (Vf) to the ultra-high voltage (Eb) as the parameters.

If the electron gun for the color cathode ray tube of a general BPF type is adapted to the cathode ray tube having a high resolution, the ratio of the focusing voltage (Vf) to the ultra-high voltage (Eb) should be higher and the length of the third grid electrode 4 should be extended. Nevertheless, like an electron gun of any BPF type, it can not be satisfied with respect to the assembly accuracy because it needs the careful attention to the stable support of the third grid electrode 4 elongated in the manufacturing of its assembly. Furthermore, the increased total length of the electron gun causes the extension of the length on the axis of the cathode ray tube at a higher possibility.

On the other hand, even though the focusing performance of the main electrostatic focusing lens is enhanced by its magnification, it deteriorates the spherical aberration effect to the effect of the extension in the length a of the third grid electrode 4 as indicated in the general formula (2) below.

$$\Delta rf = cra^3 \tag{2}$$

Wherein C is a spherical aberration coefficient, and ra is the scope of an area which an electron beam occupies in a main electrostatic focusing lens.

In other words, if the electron beam emitted from the triode reaches the main electrostatic focusing lens at a fixed angle 0, the extension of the length of the third grid electrode 4, for example the object distance, broadens the scope of the area occupied by the electron beam in the electrostatic focusing electrode under the formula of $ra = P\tan\theta$. The substitution of this familiar for the general formula (2) significantly expounds more and more the broadened part $\Delta rf$ of a beam spot due to its spherical aberration.

The size of the beam spot observed in general on the screen is known that the affects attributing to each of the magnification and the spherical aberration are corresponding to about 75% and 25%. Therefore, assuming that the deterioration degree of the beam spot due to the spherical aberration could not be neglected, it has been eagerly attempted to reduce the beam emission angle from the triode in proportion to the extension of the object distance in the electron gun of a BPF type, but the acceptable results have not been obtained under the burden of performing the reduction of the emission angle without the adverse effect of the electric characteristics occurred by the modulation of the electron beam in the triode, etc..

OBJECTS OF INVENTION

An object of the invention is to provide an electron gun for a cathode ray tube configured to resolve the problems of the inferior assembly due to the extension of electrodes to be coupled to each another and the increasing in the length of the cathode ray tube as well as to remove the deterioration of the resolution due to the spherical aberration effect, in which the drift space of the electron beam is secured in the electron gun and the focusing electrode of main electrostatic focusing electrodes, which is applied to a lower voltage, is allocated into two to get the inter-grid assembly made of ceramics to be integrally installed therebetween, so that the focusing performance of the electron beam enables the multi-focusing effect to be obtained.

The other object of the invention is to provide an electron gun for a cathode ray tube for enhancing its assembly and accuracy attributing to the configuration of one focusing electrode in the outer form.

SUMMARY OF THE INVENTION

In order to accomplish these and those objects of the invention, the invention comprises an electron gun arranged in sequence following by a cathode, a first grid electrode, a second grid electrode, a third grid electrode assembly including an inter-grid assembly installed between the lower electrode and the upper electrode, the third grid electrode being made into a first accelerating/focusing electrode, a fourth grid electrode considered as a second accelerating/focusing electrode, a main electrostatic focusing lens formed between the fourth grid electrode and the upper electrode of the third grid electrode assembly to receive the electron beam emitted from the triode referred to as the third grid electrode assembly and other electrostatic focusing lens formed in an electrostatic optical arrangement between the inter-grid assemblies, these elements being started from the lower portion on the axis of the cathode ray tube.

BRIEF DESCRIPTION OF THE DRAWINGS

The invention will be explained in detail with reference to the accompanying drawings as follows, in which:

FIG. 5 is an equivalent optical simulation view illustrating the focusing relation of electron beams, in which

DETAILED DESCRIPTION OF INVENTION

Figure 1:
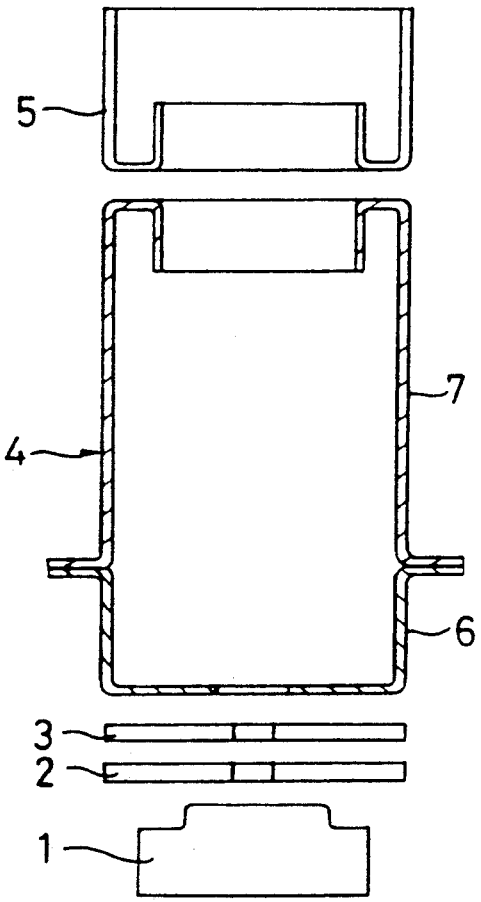
FIG. 1 is a view illustrating the conventional configuration of an electron gun for a cathode ray tube.
Figure 2:
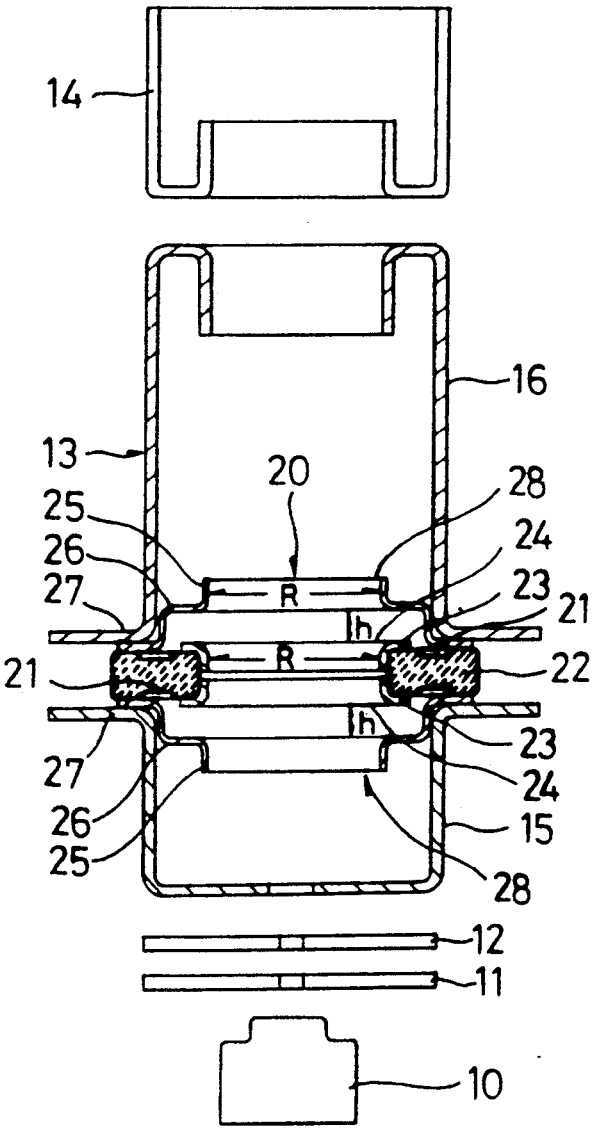
FIG. 2 is a longitudinal cross-section view illustrating the configuration of an electron gun for a cathode ray tube according to one embodiment of the invention.

As shown in FIG. 2, the invention comprises an electron gun for a cathode ray tube, arranged in sequence following by a first grid electrode 11, a second grid electrode 12, a third grid electrode assembly 13 and a fourth grid electrode assembly 14 toward the upper portion of a cathode 10.

Figure 3:
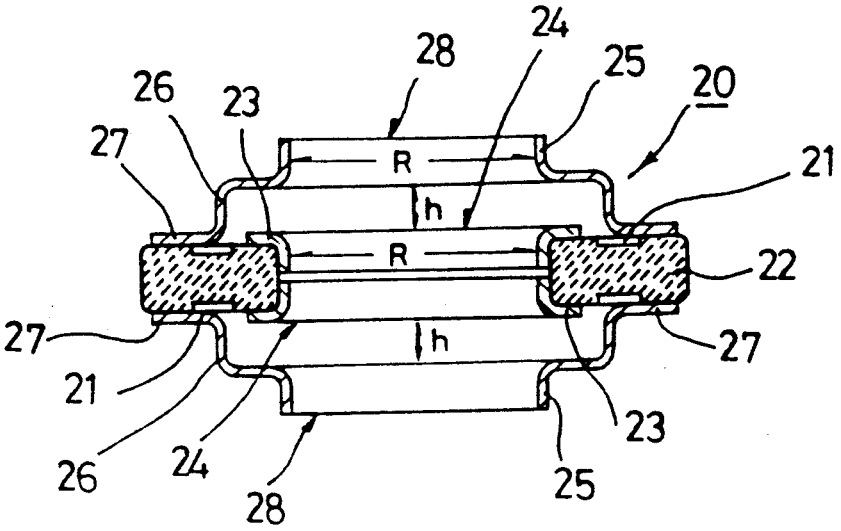
FIG. 3 is a detail view showing an inter-grid assembly according to the invention.

The third grid electrode assembly 13 includes an inter-grid assembly 20 installed between its lower electrode 13 and upper electrode 15 by means of welding. The inter-grid assembly 20, which is shown in FIG. 3, has grooves 21 at the upper and lower surfaces made into the crosssection of the wave form. A ceramic ring 22 is covered over the remaining portion except for the grooves 21 by a metal film. An inner lip 24 is attached to the inner periphery of the ceramic ring 22, at the opening end of which a flange 23 is extended. An outer lip 28 is formed into two step metal cylindrical portions, one narrower cylindrical portion 25 which has the inner diameter R equal to that of the inner lip 24, and other wider cylindrical portion 26 which has a flange 27 formed at the opening end.

The inter-grid assembly 20 is assembled using predetermined jigs in a manner which the lower outer lip 28, the lower inner lip 24, the ceramic ring 22, the upper inner lip 24 and the upper outer inner lip are stacked on one another in sequence, the flange 23 of the inner lip 24 is welded by means of conventional brazing to the inner upper surface of the ceramic ring 22, and similarly the flange of the outer lip 28 to the outer upper surface of the ceramic ring 22 in order to integrate these parts into one unit. At this time, the electrode gap (h) between the inner lip 24 and the outer lip 28 is set to correspond to the height of the wider cylindrical portion 27 of the outer lip 28.

The electron gun for the cathode ray tube according to the invention also forms the metal film over a power inducing tap means or the utmost peripheral surface between the third grid lower electrode 15 and the third grid upper electrode 16 to be electrically connected to each other. The inner lip 24 of the inter-grid assembly 20 is positioned between the power inducing paths, to which the third grid lower electrode 15, the lower outer lip 28, the upper outer lip 28 and the third grid upper electrode 16 are electrically connected, with being electrically separated by the grooves 21 of the ceramic ring 22 due to the area covered by the metal film. Therefore, it is connected to a predetermined source voltage using other power inducing tap means or to the second grid electrode 12.

Herein, the invention is operated when the predetermined voltages are respectively applied to each of the electrodes of the electron gun for a cathode ray tube. That is, the upper and lower outer lips 28 of the inter-grid assembly 20 is connected to the focusing voltage (Vf) equal to that of the outer electrode of the third grid electrode assembly 13. which is arranged in the third grid electrode assembly 13. The inner lip 24 is applied through the power inducing tap to the voltage of the second grid electrode voltage (Ec2) or the equivalent voltage similar to that of the second grid electrode voltage (Ec2) so as to optically form an UPF (Uni-Potential Focus) electrostatic lens among the outer lip 28 (applied to the ultra-high voltage Vf), the inner lip 24 (applied to the voltage Ec2) and the outer lip 28 (applied to the voltage Vf) (only indicating $Vf > Ec2$).

Thus, the electron beam emitted at a predetermined angle $\theta$ from a triode including the cathode 10, the first grid electrode 11 and the second grid electrode 12 is partly focused by means of the UPF electrostatic lens before entering into the main electrostatic focusing lens formed between the third grid upper electrode 16 of the third grid electrode assembly 13 and the fourth grid electrode 14. The focused electron beam is continuously moved forward keeping the emission angle ($\theta' < \theta$) in the main electrostatic focusing lens.

Figure 5A:
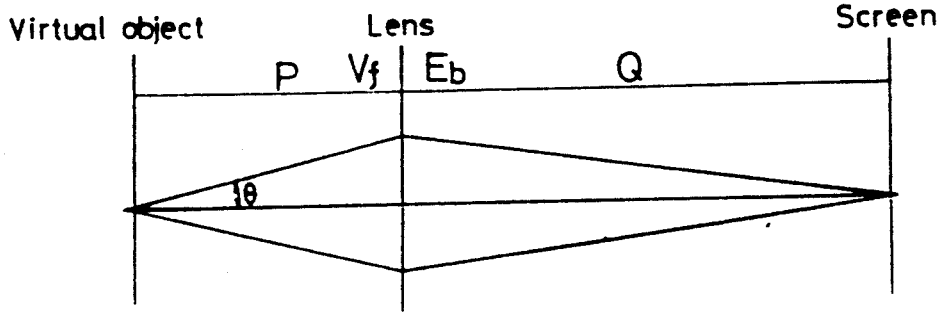
FIG. 5A is corresponding to the conventional electron gun for the cathode ray tube and FIG. 5*b* is belonging to the electron gun for the cathode ray tube according to the invention.
Figure 5B:
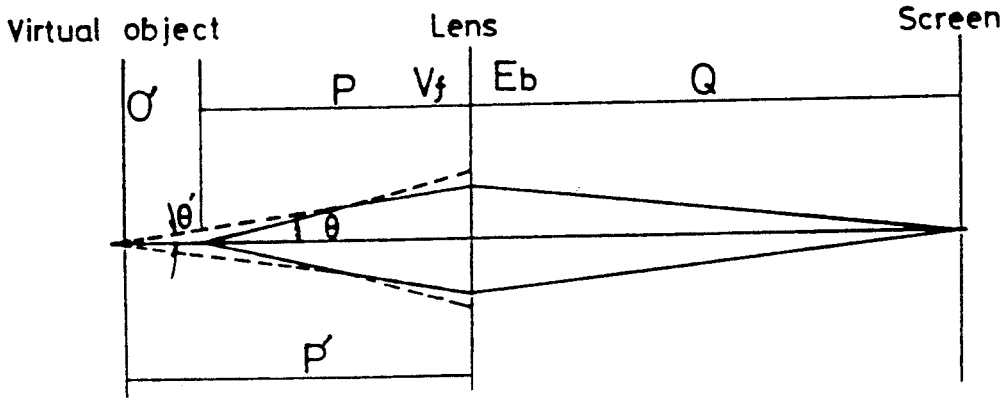
Figure 6:
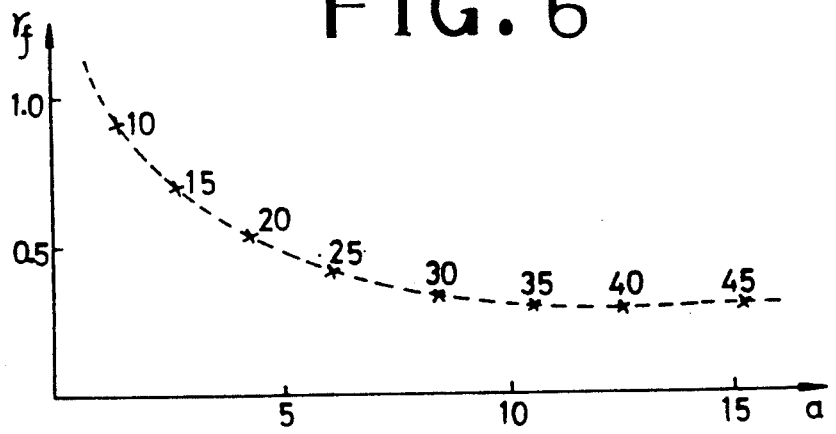
FIG. 6 is a graph illustrating the correlation between the length of a third grid electrode and the size rf of the beam spot considering the rates of the focusing voltage to the ultra-voltage as the parameters.

FIG. 5B is a equivalent optical simulation view of an electron gun for cathode ray tube according to the invention. According to the invention, the electron beam emitted at the angle $\theta$ from the triode is moved at the emission angle $\theta'$ looking at the main electrostatic focusing lens to occupy the smaller area in the main electrostatic focusing lens.

Also, the position of the virtual object from the main electrostatic focusing lens becomes far away by the object distance ($P' > P$) from the main electrostatic focusing lens to the virtual object. As the object distance (P) is more extended, the focusing voltage is increased. It means that the ratio of the focusing voltage (Vf) to the ultra-high voltage (Eb) of the main electrostatic focusing lens is increased to be capable of extending the object distance without lengthening the third grid electrode.

As described above, an electron gun for a cathode ray tube according to the invention can extend the object distance (P') contributing to the increased ratio of the focusing voltage (Vf) to the ultra-high voltage (Eb) of the main electrostatic focusing lens without lengthening the third grid electrode. Thus, the magnification (M) of the main electrostatic lens is reduced to obtain the small beam spot on the screen of the cathode ray tube. At that time, even though the object distance is extended, the deterioration of the focusing performance should not occur due to the spherical aberration based on the general formula (2). That is why the emission angle ($\theta' > \theta$) is reduced by the action of the main electrostatic focusing lens and the area occupied by the electron beam in the main electrostatic focusing lens is not enlarged.

Furthermore, comparing with an electron gun of BPF type having the ratio of a focusing voltage (Vf) to an ultra-high voltage (Eb) equal to that of the electron gun mentioned above, the shorter length of the electron gun does not lead the enlargement of the width of the cathode ray tube, and the manufacturing of the electron gun can promise the superior assembly accuracy using the third grid electrode assembly 13 of the shorter length assembled in other production line.

Figure 4:
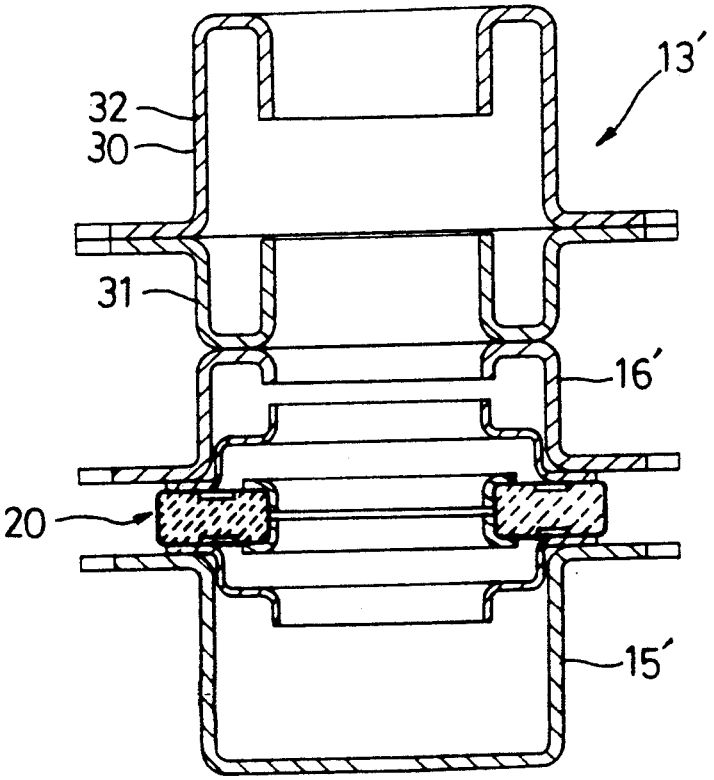
FIG. 4 is a longitudinal cross-section view illustrating an electron gun for a cathode ray tube according to another embodiment of the invention.

FIG. 4 is a crosssectional view showing the other embodiment of a third grid electrode assembly 13' constituting an electron gun for a cathode ray tube according to the invention. This embodiment is so constructed that the configuration of a third grid electrode assembly 13' and an inter-grid assembly 20 is the same as that of the third grid electrode assembly 13 according to the first embodiment, and the configuration of the third grid upper electrode 16 in the third grid electrode assembly 13 is faced to a third grid upper electrode 16' and a third grid electrode 30 mounted thereon.

The inter-grid assembly 20 is arranged between the third grid lower 15' and the third grid upper electrode 16' to be welded to each. The third grid electrode assembly 13' welded with a lower electrode 31 and an upper electrode 32 is superposed on the upper surface of the third grid upper electrode 16'.

The third grid electrode assembly 13' as shown in FIG. 4 enhances not only the accuracy required in the manufacturing of the metal electrode elements but also the assembling accuracy of the parts by the brazing and welding connection.

The invention explains only the embodiment having one electron beam passage till now, but it is not intended to limit the invention thereto, and further this electron beam passage can be preferably adapted to an electron gun for a color cathoderay tube having three electron beam passages arranged in parallel on the same plane.

What is claimed is:

1. An electron gun for a cathode ray tube arranged vertically from the bottom of axis of the cathode ray tube in the sequence of a cathode, a first grid electrode, a second grid electrode, a first accelerating/focusing electrode, and a second accelerating/focusing electrode comprising:

a third grid electrode assembly having a lower electrode and an upper electrode, including an inter-grid assembly installed between the lower electrode and the upper electrode, forming the first accelerating/focusing electrode;

a main electrostatic focusing lens formed between a fourth grid electrode and the upper electrode of the third grid electrode assembly to receive the electron beam emitted at a predetermined angle from the third grid electrode assembly; and an electrostatic focusing lens formed in an electrostatic optical arrangement between the inter-grid assembly and the upper and lower electrodes installed in the third grid electrode assembly to perform multifocussing of the electron beam on a screen.

2. An electron gun for a cathode ray tube as claimed in claim 1, wherein:

the third grid electrode assembly includes the inter-grid assembly integrally installed between its lower electrode and upper electrode by welding to enhance the accuracy in manufacturing of the metal electrode parts.

3. An electron gun for a cathode ray tube as claimed in claim 1, wherein:

the inter-grid assembly mounted between the third grid upper electrode and the third grid lower electrode includes a lower outer lip, a lower inner lip, a ceramic ring, an upper inner lip and an upper outer inner lip stacked one upon another in sequence.

4. An electron gun for a cathode ray tube as claimed in claim 3, wherein:

the inter-grid assembly includes one unit for connecting a flange of the lower inner lip to the inner surface of the ceramic ring and a flange of the lower outer lip to the outer upper surface of the ceramic ring, respectively.

5. An electron gun for a cathode ray tube as claimed in claim 3, wherein:

the electrode gap between the inner lip and the outer lip is kept equal to the height of a wider cylindrical portion of the outer lip.

6. An electron gun for a cathode ray tube as claimed in claim 3, wherein:

the upper and lower electrodes of the third grid electrode assembly are connected to a focusing voltage, and the inner lip of the inter-grid assembly mounted in the third grid electrode assembly is connected to a predetermined voltage independent of the focusing voltage or a second grid electrode voltage.

7. An electron gun for a cathode ray tube as claimed in claim 4, wherein:

the ceramic ring is covered over a remaining portion except for grooves of its upper and lower surface by a metal film.

8. An electron gun for a cathode ray tube as claimed in claim 4, wherein:

the outer lip coupled to the outer of the grooves of ceramic ring is formed into two step metal cylindrical portions, one narrower cylindrical portion of which has the inner diameter equal to that of the inner lip, and other wider cylindrical portion of which has a flange formed at an opening end.

* * * * *